US005271772A

United States Patent [19]

Riede et al.

[11] Patent Number: 5,271,772

[45] Date of Patent: Dec. 21, 1993

[54] HAZARDOUS CHEMICAL DECONTAMINATION PROCESS

[75] Inventors: Urs Riede, Freiburg; Hans W. Kleffner, Battenberg; Bernhard Seubert, Edingen, all of Fed. Rep. of Germany

[73] Assignee: Rutgerswerke AG, Fed. Rep. of Germany

[21] Appl. No.: 829,952

[22] Filed: Feb. 3, 1992

[30] Foreign Application Priority Data

Feb. 21, 1991 [DE] Fed. Rep. of Germany ..... 4105395

[51] Int. Cl.[5] ..... B08B 3/00; B08B 3/08

[52] U.S. Cl. ..... 134/2; 134/26; 252/82

[58] Field of Search ..... 134/2, 26; 252/82

[56] References Cited

U.S. PATENT DOCUMENTS

| | | | |
|---|---|---|---|
| 3,810,788 | 5/1974 | Steyermark | 134/42 |
| 4,918,059 | 4/1990 | Seubert et al. | 514/33 |
| 4,946,829 | 8/1990 | Seubert et al. | 514/730 |

FOREIGN PATENT DOCUMENTS

| | | |
|---|---|---|
| 1294609 | 3/1988 | Canada . |
| 2215603 | 2/1989 | United Kingdom . |
| 8900463 | 1/1989 | World Int. Prop. O. . |

OTHER PUBLICATIONS

Soviet Inventions Illustrated, Week 8405 issued Mar. 14, 1984.

S. Golbs et al, "Effect of humic acids on the acute toxicity of selected pesticides", Chemical abstract, vol. 102, No. 21, May 27, 1985.

*Primary Examiner*—David Brunsman
*Assistant Examiner*—Zeinab El-Arini
*Attorney, Agent, or Firm*—Bierman and Muserlian

[57] ABSTRACT

A process for the decontamination of surfaces and solid objects contaminated with hazardous chemical substances comprising treating the surfaces and solid objects with a solution of alkali metal huminates of low molecular weight and compositions used therein.

6 Claims, No Drawings

HAZARDOUS CHEMICAL DECONTAMINATION PROCESS

STATE OF THE ART

The decontamination of surfaces and solid objects contaminated with cholinesterase-inhibiting substances of organophosphate type and/or dermatotoxic substances of dichlorodiethylsulfide type is a major problem. Rapid decontamination is important but known methods do not detoxify the toxic substances but are only washed off and get into the environment with their full toxic biological activity. German application Serial No. P 40 22 795.2 detoxifies pollutants dissolved in water by the addition of 10 to 50 ppm of alkali metal huminates of low molecular weight.

OBJECTS OF THE INVENTION

It is an object of the invention to provide a novel process and novel compositions for rapidly decontaminating surfaces and solid objects wherein the toxic substances are detoxified with a minimum danger to humans and pollution of the environment.

These and other objects and advantages of the invention will become obvious from the following detailed description:

THE INVENTION

The process of the invention for decontaminating surfaces and solid objects contaminated with hazardous chemical substances comprises treating the surfaces and solid objects with a solution of an alkali metal huminate of low molecular weight. The treatment detaches the pollutants from the surface and solid objects and detoxifies the pollutants in the solution.

The process is useful particularly in the cases of organophosphate pollutants as well as well as N-Lost and S-Lost. Examples of such organophosphates are compounds of the structure

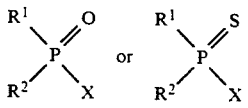

where $R^1$ and $R^2$ are individually alkyl, alkoxy, or alkylthio of 1 to 7 carbon atoms, preferably 1 to 4 carbon atoms and amino and X is a readily dissociable group such as halogen, cyanide, phenoxy or thiol. The said compounds have a toxicity due to their irreversibly blocking acetylcholinesterase.

The treated surfaces and solid objects are free of pollutants and the resulting solutions are not toxic. The process is useful for the decontamination of surfaces such as floors, walls and masonary and solid objects such as tools, machinery and clothing.

The compositions of the invention are solutions of alkali metal huminates of low molecular weight, preferably containing 0.05 to 6% by weight of the alkali metal huminate. The more preferred concentration is 0.5 to 5%, most preferably 1 to 2%, by weight of the alkali metal huminate.

The compositions are preferably aqueous solutions but may contain up to 40% by weight of water-miscible organic solvents to increase the detachment of the organic pollutant particles from the substrate. Examples of such organic solvents are low molecular weight mono- and polyvalent alcohols or ketones.

The compositions may also contain one or more surfactants which may be which may be non-ionic or in the case of aqueous solutions, anionic or cationic surfactants.

Examples of suitable alkali metal huminates of low molecular weight are natural alkali metal huminates of low molecular weight as described in U.S. Pat. No. 4,918,059 or alkali metal huminates of low molecular weight prepared by oxidation of polyvalent phenols in weakly alkaline aqueous medium as described in U.S. Pat. No. 4,946,829. These are dark brown, water-soluble products having a mean molecular weight of about 1,000, with a range of 300 to 1,500.

The compositions are preferably stored and transported as concentrates which are diluted just before use. The alkali metal huminates of low molecular weight may also be stored in solid form and dissolved in water just before use and optionally mixed with a water-mixable organic solvent.

In the following examples, there are described several preferred embodiments to illustrate the invention. However, it should be understood that the invention is not intended to be limited to the specific embodiments.

EXAMPLE 1

A special steel plate measuring 10 cm×10 cm was contaminated with 0.5 g of parathion and was then sprayed with 20 ml of an aqueous solution of 1% of alkali metal huminate of low molecular weight of the example of European patent No. 281,678. After a 30 minute contact time, the plate was washed off with water and Daphnia magna was used as a test organism. The survival time of the microorganism was more than 24 hours.

EXAMPLE 2

Using the procedure of Example 1, a 10 cm×10 cm slab of concrete was contaminated with 0.5 g of metasystox and was then sprayed with 20 ml of a 1% aqueous solution of low molecular weight alkali metal huminate. The slab was rinsed with water and the decontamination was tested with Daphnia magna. The survival time of the microorganism was greater than 24 hours.

Various modifications of the process and compositions of the invention may be made without departing from the spirit or scope thereof and it is to be understood that the invention is intended to be limited only as defined in the appended claims.

What we claim is:

1. A process for the decontamination of surfaces and solid objects contaminated with hazardous chemical substances comprising treating the surface and solid objects with a solution of alkali metal huminates of mean molecular weight of about 1000 with a range of 300 to 1,500 which forms a non-toxic solution and then removing the resulting non-toxic solution.

2. The process of claim 1 wherein the solution is an aqueous solution.

3. The process of claim 1 wherein the solution is an aqueous solution containing water compatible organic solvents.

4. The process of claim 1 wherein the solution contains additional surfactants.

5. A process for the decontamination of surfaces and solid objects contaminated with compounds which are toxic due to their irreversibly blocking acetylcholinesterase comprising treating the contaminated surfaces and solid objects with a solution of alkali metal huminates of mean molecular weight of about 1000 with a range of 300 to 1500.

6. The process of claim 5 wherein the huminate solution is washed off after a short contact time.

* * * * *